US009798258B2

(12) United States Patent
Shiozaki et al.

(10) Patent No.: US 9,798,258 B2
(45) Date of Patent: Oct. 24, 2017

(54) ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Hirofumi Shiozaki, Minamiashigara (JP); Naomi Miyamoto, Minamiashigara (JP); Kazusei Yoshida, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/980,495

(22) Filed: Dec. 28, 2015

(65) Prior Publication Data

US 2017/0082935 A1 Mar. 23, 2017

(30) Foreign Application Priority Data

Sep. 18, 2015 (JP) ..... 2015-185969
Sep. 18, 2015 (JP) ..... 2015-185970

(51) Int. Cl.

| | |
|---|---|
| ***G03G 9/00*** | (2006.01) |
| ***G03G 9/087*** | (2006.01) |
| ***G03G 15/08*** | (2006.01) |
| ***G03G 9/08*** | (2006.01) |

(52) U.S. Cl.
CPC ..... *G03G 9/08755* (2013.01); *G03G 9/0821* (2013.01); *G03G 9/08791* (2013.01); *G03G 9/08795* (2013.01); *G03G 15/0865* (2013.01)

(58) Field of Classification Search
CPC ..... G03G 9/08755; G03G 15/0865; G03G 9/08795; G03G 9/08791; G03G 9/0821
See application file for complete search history.

(56) References Cited

U.S. PATENT DOCUMENTS

2005/0227160 A1* 10/2005 Shirai ..... G03G 9/083 430/109.4
2009/0068578 A1 3/2009 Murakami et al.

FOREIGN PATENT DOCUMENTS

| | | | |
|---|---|---|---|
| JP | S62-195682 | A | 8/1987 |
| JP | 4571975 | B2 | 10/2010 |
| JP | 2015-004721 | A | 1/2015 |

* cited by examiner

*Primary Examiner* — Thorl Chea
(74) *Attorney, Agent, or Firm* — Oliff PLC

(57) ABSTRACT

There is provided an electrostatic charge image developing toner containing: a toner particle containing an amorphous resin having a polyester resin segment and a styrene acrylic resin segment, and a crystalline polyester resin dispersed in the amorphous resin, wherein a loss modulus G" of the toner particles satisfies the following (1) and (2):

(1) the loss modulus G" at 40° C. is from $1.0\times10^7$ Pa to $1.0\times10^8$ Pa; and (2) the loss modulus G" at the time when 60 minutes has passed from start of keeping the toner particles at 55° C. is from $1.0\times10^8$ Pa to $1.0\times10^9$ Pa.

12 Claims, 2 Drawing Sheets

ELECTROSTATIC CHARGE IMAGE DEVELOPING TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATION(S)

This application is based on and claims priority under 35 U.S.C. 119 from Japanese Patent Application Nos. 2015-185969 filed on Sep. 18, 2015, and 2015-185970 filed on Sep. 18, 2015.

BACKGROUND

1. Technical Field

The present invention relates to an electrostatic charge image developing toner, an electrostatic charge image developer, a toner cartridge, a process cartridge, an image forming apparatus, and an image forming method.

SUMMARY

According to an exemplary embodiment of the present invention, there is provided an electrostatic charge image developing toner containing: a toner particle containing an amorphous resin having a polyester resin segment and a styrene acrylic resin segment, and a crystalline polyester resin dispersed in the amorphous resin, wherein a loss modulus G" of the toner particles satisfies the following (1) and (2):

(1) the loss modulus G" at 40° C. is from $1.0\times10^7$ Pa to $1.0\times10^8$ Pa; and (2) the loss modulus G" at the time when 60 minutes has passed from start of keeping the toner particles at 55° C. is from $1.0\times10^8$ Pa to $1.0\times10^9$ Pa.

BRIEF DESCRIPTION OF THE DRAWINGS

Exemplary embodiments of the present invention will be described in detail based on the following figures, wherein.

DETAILED DESCRIPTION

Figure 1:
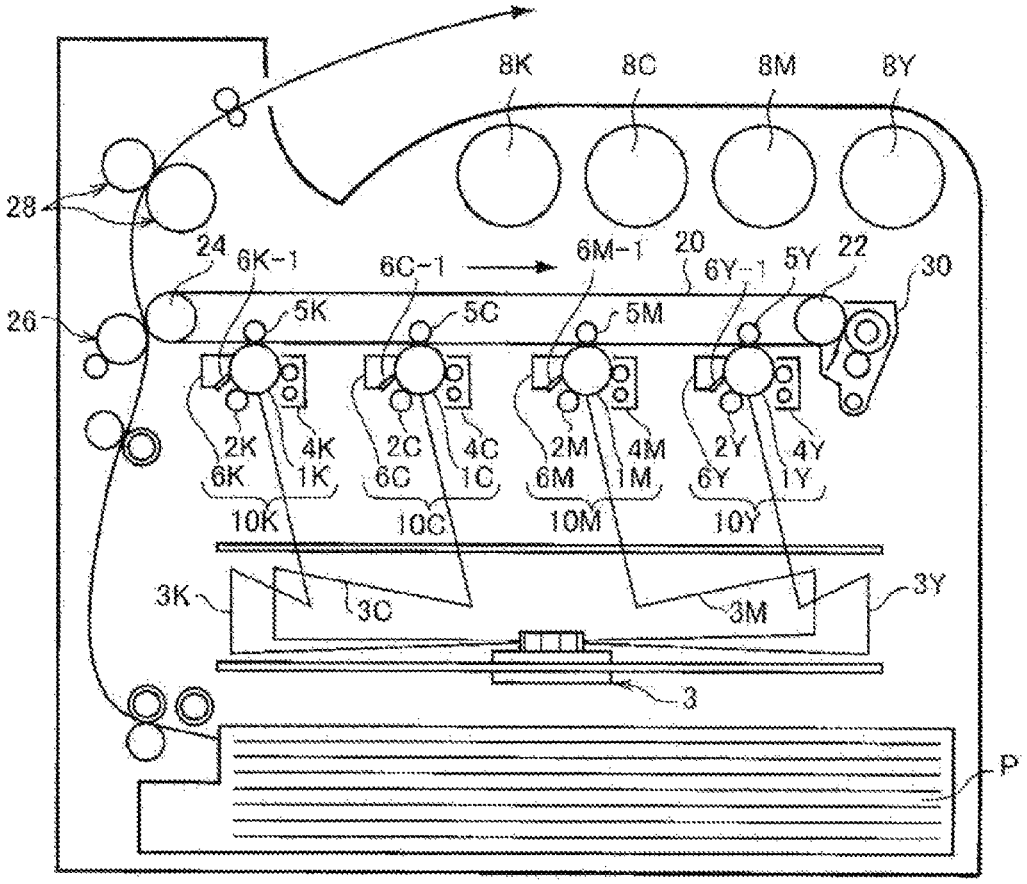
FIG. 1 is a schematic diagram showing an example of a configuration of an image forming apparatus according to an exemplary embodiment.

Hereinafter, exemplary embodiments of the present invention will be described. The descriptions and examples thereof are merely illustrative, and the range of the invention is not intended to be limited by the exemplary embodiments.

In the specification, the term "electrostatic charge image developing toner" is also simply referred to as "toner" and the term "electrostatic charge image developer" is also simply referred to as "developer".

<Electrostatic Charge Image Developing Toner>

A toner according to an exemplary embodiment includes a toner particle containing an amorphous resin having a polyester resin segment and a styrene acrylic resin segment, and a crystalline polyester resin dispersed in the amorphous resin and a loss modulus G" satisfies the following (1) and (2).

(1) The loss modulus G" at 40° C. is from $1.0\times10^7$ Pa to $1.0\times10^8$ Pa. (2) The loss modulus G" at the time when 60 minutes has passed from the start of keeping the toner at 55° C. is from $1.0\times10^8$ Pa to $1.0\times10^9$ Pa.

In the exemplary embodiment, the term "polyester resin" means a polymer having an ester bond (—COO—) in a main chain, and the term "styrene-acryl-modified polyester resin" means a resin having a main chain composed of a polyester resin, and a side chain composed of a styrene acrylic resin chemically bonded to the main chain.

The term "amorphous resin having a polyester resin segment and a styrene acrylic resin segment" in the present disclosure also refers to "hybrid amorphous resin". In the hybrid amorphous resin, the polyester resin segment is chemically bonded with the styrene acrylic resin segment.

The hybrid amorphous resin in the exemplary embodiment includes a resin having a main chain composed of a polyester resin and a side chain composed of a styrene acrylic resin chemically bonded to the main chain; a resin having a main chain composed of a styrene acrylic resin and a side chain composed of a polyester resin chemically bonded to the main chain; a resin having a main chain formed by chemically bonding a polyester resin and a styrene acrylic resin; and the like.

The term "crystalline" resin in the exemplary embodiment indicates that the resin does not exhibit a stepwise change in endothermic quantity but has a clear endothermic peak in differential scanning calorimetry (DSC), and specifically, the "crystalline" resin indicates that the half-value width of an endothermic peak when measured at a temperature rising rate of 10° C./min is within 10° C.

On the other hand, the "amorphous" resin indicates that the half-value width is greater than 10° C., a stepwise change in endothermic quantity is exhibited, or a clear endothermic peak is not recognized.

The term "loss modulus G"" in the exemplary embodiment is measured by a sinusoidal wave oscillation method using an ARES-GII measuring apparatus manufactured by GL Sciences Inc. As a sample for measurement, a sample obtained by solidifying about 0.5 g of toner by compression and pelletizing the compressed toner is used. The sample is placed between parallel plates having a diameter of 8 mm, and is made to adhere to the parallel plates by applying heat at 90° C. to 120° C.

Then, in a first aspect of the present invention, the sample made to adhere to the parallel plates is cooled to 30° C. and kept at 30° C. for 1 minute. Subsequently, the temperature is raised from 30° C. to 90° C. at a temperature rising rate of 2° C./min and the sample is cooled to 55° C. and kept at 55° C. for 60 minutes. At this time, a sinusoidal wave oscillation at a frequency of 1 Hz is applied continuously from when the temperature of the sample reaches 30° C. to measure the loss modulus G" with a measurement interval of 30 seconds.

In the exemplary embodiment, the term "loss modulus G" at 40° C." refers to a loss modulus G" at 40° C. in the course of temperature rising from 30° C. to 90° C. and the term "loss modulus G" at the time when 60 minutes has passed from the start of keeping the toner at 55° C." refers to a loss modulus G" at the time when 60 minutes has passed from the start of keeping the toner at 55° C. after being cooled to 55° C.

On the other hand, in a second aspect of the present invention, the sample made to adhere to the parallel plates is cooled to 55° C. and kept at 55° C. for 60 minutes. At this time, a sinusoidal wave oscillation at a frequency of 1 Hz is applied continuously from when the temperature of the sample reaches 55° C. to measure the loss modulus G" with a measurement interval of 30 seconds.

Since the toner according to the exemplary embodiment includes a toner particle containing a hybrid amorphous resin and a crystalline polyester resin dispersed in the amorphous resin and the loss modulus G" satisfies the aforementioned (1) and (2), excellent low temperature fixability and heat resistance are achieved.

Generally, the fixing temperature of the toner can be controlled by the glass transition temperature (Tg) or melting temperature (Tm) of a binder resin, and can be lowered by lowering the Tg or Tm of a binder resin. However, as the Tg or Tm of a binder resin becomes lower, the heat resistance of the toner becomes lower and in a developer in which the internal temperature is in a high temperature environment (for example, 50° C. to 60° C.), the aggregation (blocking) of toner particles easily occurs. That is, the low temperature fixability and the heat resistance (for example, blocking resistance) of the toner are generally contrary to each other.

In the related art, an attempt to achieve good low temperature fixability and heat resistance using a hybrid resin having a polyester resin segment and a styrene acrylic resin segment as a binder resin for toner has been made. However, it is difficult to achieve good low temperature fixability and heat resistance of toner by using only the hybrid resin.

In contrast, the toner according to the exemplary embodiment has excellent low temperature fixability and heat resistance by the loss modulus G" satisfying the aforementioned (1) and (2).

In the first aspect of the present invention, when the loss modulus G" of the toner at 40° C. is $1.0\times10^8$ Pa or less (which is equal to or less than the upper limit in the aforementioned (1)), the toner can be satisfactorily fixed at a low temperature (for example, 130° C. or lower). That is, even when the temperature at which a toner image is heated in a fixing process is low, offset (a phenomenon that an image is transferred to a fixing member, which is caused by insufficient melting of a toner image) does not easily occur. When the loss modulus G" at 40° C. is greater than $1.0\times10^8$ Pa, in the case in which the temperature at which a toner image is heated is low, offset easily occur and it is difficult to fix the toner satisfactorily.

In addition, in the second aspect of the present invention, when the loss modulus G" of the toner at the start of keeping the toner at 55° C. is $5.0\times10^7$ Pa or less (which is equal to or less than the upper limit in the aforementioned (1)), the toner can be satisfactorily fixed at a low temperature (for example, 130° C. or lower). That is, even when the temperature at which a toner image is heated in a fixing process is low, offset (a phenomenon that an image is transferred to a fixing member, which is caused by insufficient melting of a toner image) does not easily occur. When the loss modulus G" of the toner at the start of keeping the toner at 55° C. is greater than $1.0\times10^7$ Pa, in the case in which the temperature at which a toner image is heated is low, offset easily occur and it is difficult to fix the toner satisfactorily.

When the loss modulus G" of the toner at the time when 60 minutes has passed from the start of keeping the toner at 55° C. is $1.0\times10^8$ Pa or greater (which is equal to or greater than the lower limit in the aforementioned (2)), even in a high temperature environment, the surfaces of the toner particles are prevented from becoming too soft and the aggregation between the toner particles does not easily occur. When the loss modulus G" of the toner at the time when 60 minutes has passed from the start of keeping the toner at 55° C. is less than $1.0\times10^8$ Pa, in a high temperature environment, the surfaces of the toner particles become too soft and the aggregation between the toner particles easily occurs.

In the first aspect of the present invention, generally, when a toner whose loss modulus G" at 40° C. is less than $1.0\times10^7$ Pa (which is the lower limit in the aforementioned (1)), and a toner whose loss modulus G" at the time when 60 minutes has passed from the start of keeping the toner at 55° C. is greater than $1.0\times10^9$ Pa (which is the upper limit in the aforementioned (2)) are not practical. The toner whose loss modulus G" at 40° C. is less than $1.0\times10^7$ Pa easily causes offset to stacked recording mediums because a fixed image is too soft. The toner whose loss modulus G" at the time when 60 minutes has passed from the start of keeping the toner at 55° C. is greater than $1.0\times10^9$ Pa makes a fixed image too brittle because the fixed image is too hard.

On the other hand, in the second aspect of the present invention, generally, a toner whose loss modulus G" at the start of keeping the toner at 55° C. is less than $5.0\times10^6$ Pa (which is the lower limit in the aforementioned (1)) and a toner whose loss modulus G" at the time when 60 minutes has passed from the start of keeping the toner at 55° C. is greater than $1.0\times10^9$ Pa (which is the upper limit in the aforementioned (2)) are not practical. The toner whose loss modulus G" at the start of keeping the toner at 55° C. is less than $5.0\times10^6$ Pa easily causes offset to stacked recording mediums because a fixed image is too soft. The toner whose loss modulus G" at the time when 60 minutes has passed from the start of keeping the toner at 55° C. is greater than $1.0\times10^9$ Pa makes a fixed image too brittle because the fixed image is too hard.

The reason why the toner according to the exemplary embodiment satisfies the aforementioned (1) and (2) is not necessarily clear but can be presumed as follows.

In the toner particles of the exemplary embodiment, since a matrix in which the crystalline polyester resin is dissolved is the hybrid amorphous resin having a polyester resin segment and a styrene acrylic resin segment, it is considered that the crystalline polyester resin mainly dispersed therein in two states of a relatively small domain (having a major diameter of 50 nm or less) and a relatively large domain (having a major diameter of 150 nm more). When a relatively small domain is present, it is considered that the viscoelasticity reaches the upper limit in the aforementioned (1), and when a relatively large domain having a filler effect is present, it is considered that the viscoelasticity reaches the lower limit in the aforementioned (2). That is, since a dispersion state of the crystalline polyester resin is obtained in which both the relatively small domain and the relatively large domain are present in the matrix of the hybrid amorphous resin, it is considered that the aforementioned (1) and (2) are satisfied.

In the exemplary embodiment, from the viewpoint of more easily exhibiting the dispersion state, thus more easily satisfying the aforementioned (1) and (2), and as a result, achieving further excellent low temperature fixability and heat resistance of the toner, the weight ratio between the hybrid amorphous resin and the crystalline polyester resin included in the toner particles is preferably from 80:20 to 70:30. When the weight ratio of the crystalline polyester resin is 20 or more, the domain of the resin more easily grows larger. On the other hand, when the weight ratio of the crystalline polyester resin is 30 or less, the domain of the resin does not become too large, and both a relatively small domain and a relatively large domain are easily formed in the toner particles. From the above viewpoint, the weight ratio between the hybrid amorphous resin and the crystalline polyester resin included in the toner particles is preferably from 80:20 to 70:30, more preferably from 80:20 to 75:25, and still more preferably from 80:20 to 78:22.

From the viewpoint of more easily exhibiting the dispersion state, thus more easily satisfying the aforementioned (1) and (2), and as a result, achieving further excellent low temperature fixability and heat resistance of the toner, the hybrid amorphous resin is preferably an amorphous styrene-acryl-modified polyester resin (a resin having a main chain composed of a polyester resin and a side chain composed of a styrene acrylic resin chemically bonded to the main chain).

From the viewpoint of more easily exhibiting the dispersion state, thus more easily satisfying the aforementioned (1) and (2), and as a result, achieving further excellent low temperature fixability and heat resistance of the toner, the crystalline polyester resin dispersed in the hybrid amorphous resin is preferably a crystalline styrene-acryl-modified polyester resin (a resin having a main chain composed of a polyester resin and a side chain composed of a styrene acrylic resin chemically bonded to the main chain).

Hereinafter, the configuration of the toner according to the exemplary embodiment will be more specifically described.

[Toner Particles]

The toner particle contains a hybrid amorphous resin and a crystalline polyester resin. The toner particle may further contain other resins, a release agent, a colorant, and other additives.

—Hybrid Amorphous Resin—

The toner particle contains at least one hybrid amorphous resin.

The hybrid amorphous resin is not particularly limited as long as the resin is an amorphous resin having a polyester resin segment and a styrene acrylic resin segment in a molecule.

As the hybrid amorphous resin to be used, any of a resin having a main chain composed of a polyester resin and a side chain composed of a styrene acrylic resin chemically bonded to the main chain; a resin having a main chain composed of a styrene acrylic resin and a side chain composed of a polyester resin chemically bonded to the main chain; a resin formed by chemically bonding a polyester resin and a styrene acrylic resin; and the like may be used.

The hybrid amorphous resin according to the exemplary embodiment is preferably an amorphous resin having a main chain composed of a polyester resin and a side chain composed of a styrene acrylic resin chemically bonded to the main chain, that is, an amorphous styrene-acryl-modified polyester resin. The main chain in the amorphous styrene-acryl-modified polyester resin is preferably an amorphous polyester resin.

Polyester Resin Segment

Examples of the polyester resin segment of the hybrid amorphous resin include a condensation polymer of a polyol and a polyvalent carboxylic acid.

Examples of the polyol include aliphatic diols (such as ethylene glycol, diethylene glycol, triethylene glycol, propylene glycol, butanediol, hexanediol, and neopentyl glycol), alicyclic diols (such as cyclohexanediol, cyclohexanedimethanol, and hydrogenated bisphenol A), and aromatic diols (such as ethylene oxide adducts of bisphenol A and propylene oxide adducts of bisphenol A).

As the polyol, a tri- or higher valent polyol having a crosslinked structure or a branched structure may be used together with a diol. Examples of the tri- or higher-valent polyol include glycerin, trimethylolpropane, and pentaerythritol. The polyols may be used singly or in combination of two or more kinds thereof.

In an alcohol component of the polyester resin segment of the hybrid amorphous resin, from the viewpoint of easily satisfying the aforementioned (1) and (2) due to the dispersion state of the crystalline polyester resin, and as a result, achieving further excellent low temperature fixability and heat resistance of the toner, at least one aliphatic diol having 2 to 5 carbon atoms is preferably contained. The aliphatic chain of the aliphatic diol having 2 to 5 carbon atoms may be acyclic or cyclic. When the aliphatic chain is acyclic, the chain may be linear or branched. The aliphatic diol having 2 to 5 carbon atoms is preferably an acyclic aliphatic diol having 2 to 5 carbon atoms and more preferably a linear aliphatic diol having 2 to 5 carbon atoms.

Examples of the aliphatic diol having 2 to 5 carbon atoms include ethylene glycol, 1,3-propanediol, propylene glycol, 1,2-butanediol, 1,3-butanediol, 1,4-butanediol, 2,3-butanediol, 1,5-pentanediol, 1,2-cyclopentanediol, 1,2-pentanediol, 1,3-pentanediol, pentane-2,3-diol, and neopentyl glycol.

A ratio of the aliphatic diol having 2 to 5 carbon atoms in the alcohol component of the polyester resin segment of the hybrid amorphous resin is preferably from 70% by mole to 100% by mole, more preferably from 80% by mole to 100% by mole, and still more preferably from 90% mole to 100% by mole.

Examples of the polyvalent carboxylic acid include aliphatic dicarboxylic acids (such as oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), anhydrides thereof, and lower alkyl esters (having, for example, 1 to 5 carbon atoms) thereof. Among these, for example, aromatic dicarboxylic acids are preferable as the polyvalent carboxylic acid.

The polyvalent carboxylic acid may be used in combination with a tri- or higher-valent carboxylic acid having a crosslinked structure or a branched structure, together with a dicarboxylic acid. Examples of the tri- or higher-valent carboxylic acid include trimellitic acid, pyromellitic acid, anhydrides thereof, and lower alkyl esters (having, for example, 1 to 5 carbon atoms) thereof.

The polyvalent carboxylic acids may be used singly or in combination of two or more kinds thereof.

In a carboxylic acid component of the polyester resin segment of the hybrid amorphous resin, at least one of dicarboxylic acids having a nonaromatic carbon-carbon unsaturated bond and having carboxy groups at both ends thereof is preferably included. The dicarboxylic acid is subjected to polycondensation with a polyol to form a part of polyester resin segment and styrenes or acrylic ester resins are additionally polymerized with a carbon-carbon unsaturated bond derived from the dicarboxylic acid. Thus, the styrene acrylic resin segment is chemically bonded to the polyester resin segment.

As the dicarboxylic acid having a nonaromatic carbon-carbon unsaturated bond and having carboxy groups at both ends thereof, an unsaturated aliphatic dicarboxylic acid (the aliphatic chain may be acyclic or cyclic) is preferable and examples thereof include fumaric acid, maleic acid, and 1,2,3,6-tetrahydrophthalic acid. As the unsaturated aliphatic dicarboxylic acid, from the viewpoint of reactivity, fumaric acid is preferable.

The ratio of the dicarboxylic acid having a nonaromatic carbon-carbon unsaturated bond and having carboxy groups at both ends thereof in the carboxylic acid component of the polyester resin segment of the hybrid amorphous resin is more than 0% by mole and less than 20% by mole, more preferably from 0.5% by mole to 15% by mole, still more preferably from 1% by mole to 10% by mole, even still more preferably from 1% by mole to 5% by mole, and most preferably from 1% by mole to 3% by mole, from the viewpoint of achieving further low temperature fixability and heat resistance of the toner.

Styrene Acrylic Resin Segment

Examples of the styrene acrylic resin segment of the hybrid amorphous resin include a segment formed by addition polymerization of an addition polymerizable monomer. As the addition polymerizable monomer constituting the styrene acrylic resin segment, styrenes, acrylic esters, and monomers having an ethylenically unsaturated double bond, which are generally used for synthesis of the styrene acrylic resin, may be used. Specific examples thereof include styrenes such as styrene, methylstyrene, α-methylstyrene, β-methylstyrene, t-butylstyrene, chlorostyrene, chloromethyl styrene, methoxystyrene, styrenesulfonic acid, and salts thereof; acrylic esters such as alkyl (meth)acrylate (for example, having 1 to 18 carbon atoms), benzyl (meth) acrylate, and dimethylaminoethyl (meth)acrylate; olefins such as ethylene, propylene and butadiene; halovinyls such as vinyl chloride; vinyl esters such as vinyl acetate, vinylpropionate; vinyl ethers such as vinyl methyl ether; vinylidene halogenates such as vinylidene chloride; and N-vinyl compounds such as N-vinyl pyrrolidone.

As the hybrid amorphous resin in the exemplary embodiment, an amorphous resin having a main chain composed of a polyester resin and a side chain composed of a styrene acrylic resin chemically bonded to the main chain, that is, an amorphous styrene-acryl-modified polyester resin is preferable.

As a method of producing the styrene-acryl-modified polyester resin, a method including preparing an amorphous polyester resin having a nonaromatic carbon-carbon unsaturated bond by polycondensation of an alcohol component and a carboxylic acid component, and under the presence of the amorphous polyester resin, subjecting the prepared resin to addition polymerization with an addition polymerizable monomer is preferable. Specific examples thereof include a method including directly mixing a polyester resin having a nonaromatic carbon-carbon unsaturated bond with an addition polymerizable monomer for addition polymerization; a method including dissolving a polyester resin having a nonaromatic carbon-carbon unsaturated bond and an addition polymerizable monomer in an organic solvent for addition polymerization; and a method including a process of obtaining an aqueous dispersion by preparing a polyester resin having a nonaromatic carbon-carbon unsaturated bond and mixing the polyester resin with a water-soluble medium, and a process of obtaining an aqueous dispersion of resin particles composed of a styrene-acryl-modified polyester resin by adding an addition polymerization monomer to the aqueous dispersion and subjecting the resultant to addition polymerization with the polyester resin for addition polymerization.

The weight ratio between the polyester resin segment and the styrene acrylic resin segment (polyester resin segment: styrene acrylic resin segment) included in the hybrid amorphous resin is preferably 90:10 to 70:30 and more preferably 85:15 to 75:25 from the viewpoint of more easily satisfying the aforementioned (1) and (2), and as a result, achieving further excellent low temperature fixability and heat resistance of the toner.

The weight average molecular weight (Mw) of the hybrid amorphous resin is preferably from 5,000 to 50,000, more preferably from 10,000 to 40,000, and still more preferably from 15,000 to 35,000.

The weight average molecular weight and the number average molecular weight of the resin are measured by gel permeation chromatography (GPC). The molecular weight measurement by GPC is performed by using GPC manufactured by Tosoh Corporation, HLC-8120GPC, as a measuring device, column manufactured by Tosoh Corporation TSKGEL SUPER HM-M (15 cm), and a THF solvent. The weight average molecular weight and the number average molecular weight are calculated using a molecular weight calibration curve plotted from a monodisperse polystyrene standard sample from the results of the above measurement.

The glass transition temperature (Tg) of the hybrid amorphous resin is preferably from 50° C. to 80° C., more preferably from 50° C. to 70° C., and still more preferably from 50° C. to 65° C.

The glass transition temperature of the resin is obtained from a DSC curve obtained by differential scanning calorimetry (DSC). More specifically, the glass transition temperature is obtained from the "extrapolated glass transition onset temperature" described in the method of obtaining a glass transition temperature in the "testing methods for transition temperatures of plastics" in JIS K7121-1987.

—Crystalline Polyester Resin—

The toner particles include at least one crystalline polyester resin dispersed in the hybrid amorphous resin.

In the exemplary embodiment, as a crystalline polyester resin included in the hybrid amorphous resin in a dispersed state, a crystalline styrene-acryl-modified polyester resin is preferable. The crystalline styrene-acryl-modified polyester resin easily disperses in the hybrid amorphous resin and easily forms a relatively small domain. Also, the crystalline styrene-acryl-modified polyester resin is mixed with the hybrid amorphous resin, for example, at a weight ratio of 80:20 to 70:30 (hybrid amorphous resin:crystalline styrene-acryl-modified polyester resin) and thus also easily forms a relatively large domain.

The main chain of the crystalline styrene-acryl-modified polyester resin is the crystalline polyester resin. Since the crystalline polyester resin is common with the main chain of the crystalline styrene-acryl-modified polyester resin, the crystalline polyester resin and the main chain of the crystalline styrene-acryl-modified polyester resin will be collectively described below.

Crystalline Polyester Resin (Main Chain of Crystalline Styrene-Acryl-Modified Polyester Resin)

Examples of the crystalline polyester resin include a condensation polymer of a polyol and a polyvalent carboxylic acid. As the crystalline polyester resin, due to ease of formation of a crystalline structure, a polymerizable monomer obtained by using a linear aliphatic polymerizable monomer is more preferable than a polymerizable monomer having an aromatic ring.

Examples of the polyol include aliphatic diols (such as linear aliphatic diols having 7 to 20 carbon atoms in the main chain part). Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferably used as the aliphatic diol.

As the polyol, a tri- or higher-valent polyol having a crosslinked structure or a branched structure may be used in combination together with diol. Examples of the tri- or higher-valent polyol include glycerin, trimethylolethane, trimethylolpropane, and pentaerythritol.

The polyols may be used singly or in combination of two or more kinds thereof.

In the alcohol component of the crystalline polyester resin, from the viewpoint of easily satisfying the aforementioned (1) and (2) by the dispersion state of the crystalline polyester resin, and as a result, achieving further excellent low temperature fixability and heat resistance of the toner, at least one aliphatic diol having 2 to 10 carbon atoms is preferably included. The aliphatic chain of the aliphatic diol having 2 to 10 carbon atoms may be acyclic or cyclic. When the aliphatic chain is acyclic, the chain may be linear or branched. The aliphatic diol having 2 to 10 carbon atoms is preferably an acyclic aliphatic diol having 2 to 10 carbon atoms and more preferably a linear aliphatic diol having 2 to 10 carbon atoms.

Examples of the aliphatic diol having 2 to 10 carbon atoms include ethylene glycol, 1,3-propanediol, propylene glycol, 1,2-butanediol, 1,3-butanediol, 1,4-butanediol, 2,3-butanediol, 1,5-pentanediol, 1,2-cyclopentanediol, 1,2-pentanediol, 1,3-pentanediol, pentane-2,3-diol, neopentyl glycol, 1,6-hexanediol, 1,4-cyclohexanediol, 1,3-cyclohexanediol, 2,5-hexanediol, 2-ethyl-1,3-hexanediol, 1,7-heptanediol, 1,4-heptanediol, 1,6-heptanediol, 1,8-octanediol, 2,4-octanediol, 1,6-octanediol, 1,9-nonanediol, 1,5-nonanediol, 2,8-nonanediol, 1,10-decanediol, 4,7-decanediol, and 1,9-decanediol.

The ratio of the aliphatic diol having 2 to 10 carbon atoms in the alcohol component of the crystalline polyester resin is preferably from 80% by mole to 100% by mole and more preferably from 90% by mole to 100% by mole.

Examples of the polyvalent carboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (dibasic acids such as phthalic acid, isophthalic acid, terephthalic acid, and naphthalene-2,6-dicarboxylic acid), anhydrides thereof, and lower alkyl esters (having, for example, 1 to 5 carbon atoms) thereof.

The polyvalent carboxylic acid may be used in combination with a tri- or higher-valent carboxylic acid having a crosslinked structure or a branched structure, together with a dicarboxylic acid. Examples of the tri- or higher-valent carboxylic acid include aromatic carboxylic acids (such as 1,2,3-benzenetricarboxylic acid, 1,2,4-benzene tricarboxylic acid, and 1,2,4-naphthalenetricarboxylic acid), anhydrides thereof, and lower alkyl esters (having, for example, 1 to 5 carbon atoms) thereof.

As the polyvalent carboxylic acid, together with these dicarboxylic acids, a sulfonic acid group containing dicarboxylic acid or an ethylenic double bond containing dicarboxylic acid may be used in combination.

The polyvalent carboxylic acids may be used singly or in combination of two or more kinds thereof.

In the carboxylic acid component of the crystalline polyester resin, from the viewpoint of easily satisfying the aforementioned (1) and (2) by the dispersion state of the crystalline polyester resin, and as a result, achieving further excellent low temperature fixability and heat resistance of the toner, at least one dicarboxylic acid having 6 to 12 carbon atoms is preferably included.

As the dicarboxylic acid having 6 to 12 carbon atoms, a dicarboxylic acid having an aliphatic chain between two carboxy groups is preferable. In this case, the aliphatic chain may be acyclic or cyclic. When the aliphatic chain is acyclic, the chain may be linear or branched.

The dicarboxylic acid having 6 to 12 carbon atoms is preferably an acyclic aliphatic dicarboxylic acid having 6 to 12 carbon atoms and more preferably a linear aliphatic dicarboxylic acid having 6 to 12 carbon atoms.

Examples of the dicarboxylic acid having 6 to 12 carbon atoms include adipic acid (1,4-butanedicarboxylic acid), phthalic acid (benzene-1,2-dicarboxylic acid), terephthalic acid (benzene-1,4-dicarboxylic acid), pimelic acid (1,5-pentanedicarboxylic acid), suberic acid (1,6-hexanedicarboxylic acid), azelaic acid (1,7-heptanedicarboxylic acid), sebacic acid (1,8-octanedicarboxylic acid, undecanedioic acid (1,9-nonanedicarboxylic acid), and dodecanedioic acid (1,10-decanedicarboxylic acid).

The ratio of the dicarboxylic acid having 6 to 12 carbon atoms in the carboxylic acid component of the crystalline polyester resin is preferably from 80% by mole to 100% by mole and more preferably from 90% by mole to 100% by mole.

In the crystalline styrene-acryl-modified polyester resin, in the carboxylic acid component of the crystalline polyester resin which is the main chain, at least one dicarboxylic acid having a nonaromatic carbon-carbon unsaturated bond and having carboxy groups at both ends thereof is preferably included. The dicarboxylic acid is subjected to polycondensation with a polyol to form a part of the main chain and styrenes or acrylic ester resins are additionally polymerized with a carbon-carbon unsaturated bond derived from the dicarboxylic acid. Thus, the styrene acrylic resin is chemically bonded to the main chain.

As the dicarboxylic acid having a nonaromatic carbon-carbon unsaturated bond and having carboxy groups at both ends thereof, an unsaturated aliphatic dicarboxylic acid (the aliphatic chain may be acyclic or cyclic) is preferable and examples thereof include fumaric acid, maleic acid, and 1,2,3,6-tetrahydrophthalic acid. As the unsaturated aliphatic dicarboxylic acid, from the viewpoint of reactivity, fumaric acid is preferable.

In the crystalline styrene-acryl-modified polyester resin, the ratio of the dicarboxylic acid having a nonaromatic carbon-carbon unsaturated bond and having carboxy groups at both ends thereof in the carboxylic acid component of the crystalline polyester resin which is the main chain is preferably more than 0% by mole and less than 20% by mole, more preferably from 0.5% by mole to 15% by mole, still more preferably from 1% by mole to 10% by mole, even still more preferably from 1% by mole to 5% by mole, and most preferably from 1% by mole to 3% by mole, from the viewpoint of achieving further excellent low temperature fixability and heat resistance of the toner.

Side Chain of Crystalline Styrene-Acryl-Modified Polyester Resin (Styrene Acrylic Resin)

The styrene acrylic resin which is a side chain of the crystalline styrene-acryl-modified polyester resin is preferably a side chain formed by addition polymerization of an addition polymerizable monomer. As addition polymerizable monomer constituting the styrene acrylic resin, styrenes, acrylic esters, and monomers having an ethylenically unsaturated double bond, which are generally used for synthesis of the styrene acrylic resin, may be used. Specific examples thereof include monomers mentioned as examples in the description of the hybrid amorphous resin.

As a method of producing the crystalline styrene-acryl-modified polyester resin, a method including preparing a crystalline polyester resin having a nonaromatic carbon-carbon unsaturated bond by polycondensation of an alcohol component and a carboxylic acid component, and under the presence of the crystalline polyester resin, subjecting the prepared resin to addition polymerization with an addition polymerizable monomer is preferable. Specific examples thereof include the same methods mentioned in the description of the method of producing the hybrid amorphous resin.

The ratio between the polyester resin, which is the main chain, and the styrene acrylic resin, which is the side chain, (polyester resin:styrene acrylic resin) in the crystalline styrene-acryl-modified polyester resin is preferably from 95:5 to 70:30 and more preferably from 95:5 to 85:15 from the viewpoint of more easily exhibiting the above-mentioned dispersion state, thus more easily satisfying the aforementioned (1) and (2), and as a result, achieving further excellent low temperature fixability and heat resistance of the toner.

The weight average molecular weight (Mw) of the crystalline polyester resin (including the crystalline styrene-acryl-modified polyester resin) is preferably from 6,000 to 35,000, more preferably from 10,000 to 35,000, and still more preferably from 20,000 to 35,000.

The melting temperature (Tm) of the crystalline polyester resin (including the crystalline styrene-acryl-modified polyester resin) is preferably from 60° C. to 100° C., more preferably from 65° C. to 90° C., and still more preferably from 65° C. to 85° C.

The melting temperature of the resin is obtained from the "melting peak temperature" described in the method of obtaining a melting temperature in the "testing methods for transition temperatures of plastics" in JIS K7121-1987, from a DSC curve obtained by differential scanning calorimetry (DSC).

The toner particle in the exemplary embodiment may contain resins other than the hybrid amorphous resin and the crystalline polyester resin, as a binder resin. However, in the exemplary embodiment, the total amount of the hybrid amorphous resin and crystalline polyester resin is preferably from 80% to 100%, more preferably from 90% to 100%, and still more preferably 100% with respect to the total amount of the binder resin.

—Other Resins—

Examples of other resins include vinyl resins formed of homopolymers of monomers of styrenes (such as styrene, parachlorostyrene, and α-methylstyrene), acrylic esters (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether) vinyl ketones (such as vinyl methyl ketone, vinyl ethyl ketone, and vinyl isopropenyl ketone), and olefins (such as ethylene, propylene, and butadiene), or copolymers obtained by the combination of two or more of these monomers. Examples of other resins also include non-vinyl resins such as epoxy resins, polyurethane resins, polyamide resins, cellulose resins, polyether resins, and modified rosin, mixtures thereof with the above-described vinyl resins, or graft polymers obtained by polymerizing a vinyl monomer with the coexistence of such non-vinyl resins. These resins may be used singly or in combination of two or more kinds thereof.

The total content of the binder resin is, for example, preferably from 40% by weight to 95% by weight, more preferably from 50% by weight to 90% by weight, and still more preferably from 60% by weight to 85% by weight with respect to the entire toner particles.

—Colorant—

Examples of the colorant include pigments such as carbon black, chrome yellow, Hansa yellow, benzidine yellow, thuren yellow, quinoline yellow, pigment yellow, permanent orange GTR, pyrazolone orange, Balkan orange, watch young red, permanent red, brilliant carmin 3B, brilliant carmin 6B, DuPont oil red, pyrazolone red, lithol red, Rhodamine B Lake, Lake Red C, pigment red, rose bengal, aniline blue, ultramarine blue, chalco oil blue, methylene blue chloride, phthalocyanine blue, pigment blue, phthalocyanine green, and malachite green oxalate, and dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes. The colorants may be used singly or in combination of two or more kinds thereof.

If necessary, the colorant may be surface-treated or used in combination with a dispersant. Plural kinds of colorants may be used in combination.

The content of the colorant is, for example, preferably from 1% by weight to 30% by weight and more preferably from 3% by weight to 15% by weight with respect to the entire toner particles.

—Release Agent—

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto. The release agents may be used singly or in combination of two or more kinds thereof.

The melting temperature of the release agent is preferably from 50° C. to 110° C. and more preferably from 60° C. to 100° C. The melting temperature is obtained from the "melting peak temperature" described in the method of obtaining a melting temperature in the "testing methods for transition temperatures of plastics" in JIS K7121-1987, from a DSC curve obtained by differential scanning calorimetry (DSC).

The content of the release agent is, for example, preferably from 1% by weight to 20% by weight, and more preferably from 5% by weight to 15% by weight with respect to the entire toner particles.

—Other Additives—

Examples of other additives include known additives such as a magnetic material, a charge controlling agent, and an inorganic powder. The toner particles include these additives as internal additives.

[Characteristics of Toner Particles]

The toner particles may be toner particles having a single layer structure, or toner particles having a so-called core-shell structure composed of a core (core particle) and a coating layer (shell layer) coated on the core. The toner particles having a core-shell structure may be composed of, for example, a core containing a binder resin, and if necessary, other additives such as a colorant and a release agent and a coating layer containing a binder resin.

When the toner particle has a core and a coating layer, the weight ratio between the hybrid amorphous resin and the crystalline polyester resin included in the core is preferably from 80:20 to 60:40, more preferably from 80:20 to 65:35, and still more preferably from 80:20 to 70:30.

The volume average particle diameter (D50v) of the toner particles is preferably from 2 μm to 10 μm and more preferably from 4 μm to 8 μm.

Various average particle diameters and various particle diameter distribution indices of the toner particles are measured using a COULTER MULTISIZER II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5% by weight aqueous solution of surfactant (preferably sodium alkylbenzene sulfonate) as a dispersant. The obtained material is added to 100 ml to 150 ml of the electrolyte.

The electrolyte in which the sample is suspended is subjected to a dispersion treatment using an ultrasonic disperser for 1 minute, and a particle diameter distribution of particles having a particle diameter in a range from 2 μm to 60 μm is measured by a COULTER MULTISIZER II using an aperture having an aperture diameter of 100 μm. 50,000 particles are sampled.

Cumulative distributions by volume and by number are respectively drawn from the side of the small diameter with respect to particle diameter ranges (channels) separated based on the measured particle diameter distribution. The particle diameter when the cumulative percentage becomes 16% is defined as a volume particle diameter D16v and a number particle diameter D16p, while the particle diameter when the cumulative percentage becomes 50% is defined as a volume average particle diameter D50v and a number average particle diameter D50p. Furthermore, the particle diameter when the cumulative percentage becomes 84% is defined as a volume particle diameter D84v and a number particle diameter D84p.

Using these, a volume average particle diameter distribution index (GSDv) is calculated by $(D84v/D16v)^{1/2}$, and a number average particle diameter distribution index (GSDp) is calculated by $(D84p/D16p)^{1/2}$.

The shape factor SF1 of the toner particles is preferably from 110 to 150 and more preferably from 120 to 140.

The shape factor SF1 is obtained through the following expression.

$$SF1=(ML^2/A)\times(\pi/4)\times 100 \quad \text{Expression:}$$

In the expression, ML represents an absolute maximum length of a toner particle and A represents a projected area of a toner particle, respectively.

Specifically, the shape factor SF1 is numerically converted mainly by analyzing a microscopic image or a scanning electron microscopic (SEM) image by using an image analyzer, and is calculated as follows. That is, an optical microscopic image of particles scattered on the surface of a glass slide is input to an image analyzer LUZEX through a video camera to obtain maximum lengths and projected areas of 100 particles, values of SF1 are calculated by the expression, and an average value thereof is obtained.

[External Additives]

Examples of the external additive include inorganic particles. Examples thereof include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles as an external additive may be subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, a silicone oil, a titanate coupling agent, and an aluminum coupling agent. These agents may be used singly or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethyl methacrylate, and melamine resin particles) and a cleaning activator (for example, metal salt of higher fatty acid represented by zinc stearate, and fluorine polymer particles).

The amount of the external additive externally added is, for example, preferably from 0.01% by weight to 5% by weight, and more preferably from 0.01% by weight to 2.0% by weight with respect to the toner particles.

[Toner Preparing Method]

Next, a method of preparing the toner according to the exemplary embodiment will be described.

The toner according to the exemplary embodiment is obtained by externally adding an external additive to toner particles after preparation of the toner particles.

The toner particles may be prepared using any of a dry process (for example, a kneading and pulverizing method) and a wet process (for example, an aggregation and coalescence method, a suspension and polymerization method, and a dissolution and suspension method). The toner particle preparing method is not particularly limited to these processes, and a known process is employed.

Among these methods, the toner particles may be prepared by an aggregation and coalescence method.

Specifically, for example, when the toner particles are prepared by an aggregation and coalescence method, the toner particles are prepared through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to coalesce the aggregated particles, thereby forming toner particles (coalescence process).

Hereinafter, the respective processes will be described in detail.

In the following description, a method of obtaining toner particles including a colorant and a release agent will be described. However, the colorant and the release agent are used if necessary. Additives other than the colorant and the release agent may be used.

—Resin Particle Dispersion Preparation Process—

For example, a colorant particle dispersion in which colorant particles are dispersed and a release agent particle dispersion in which release agent particles are dispersed are prepared with a resin particle dispersion in which resin particles as a binder resin are dispersed.

The resin particle dispersion is prepared by, for example, dispersing resin particles by a surfactant in a dispersion medium.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as sulfuric ester salt-based, sulfonate-based, phosphatebased, and soap-based anionic surfactants; cationic surfactants such as amine salt-based and quaternary ammonium salt-based cationic surfactants; and nonionic surfactants such as polyethylene glycol-based, alkyl phenol ethylene oxide adduct-based, and polyol-based nonionic surfactants. Among these, particularly, anionic surfactants and cationic surfactants are used. Nonionic surfactants may be used in combination with anionic surfactants or cationic surfactants.

The surfactants may be used singly or in combination of two or more kinds thereof.

For the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the small diameter with respect to particle diameter ranges (channels) separated using the particle diameter distribution obtained by the measurement of a laser diffraction-type particle diameter distribution measuring device (for example, LA-700, manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and more preferably from 10% by weight to 40% by weight.

For example, the colorant particle dispersion and the release agent particle dispersion are also prepared in the same manner as in the preparation of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles in the resin dispersion.

—Aggregated Particle Forming Process—

Next, the colorant particle dispersion and the release agent dispersion are mixed together with the resin particle dispersion.

Then, the resin particles, the colorant particles, and the release agent particles are heterogeneously aggregated in the mixed dispersion, thereby forming aggregated particles having a diameter close to a target toner particle diameter and including the resin particles, the colorant particles, and the release agent particles.

Specifically, for example, an aggregating agent is added to the mixed dispersion and the pH of the mixed dispersion is adjusted to acidic (for example, the pH is from 2 to 5). If necessary, a dispersion stabilizer is added. Then, the mixed dispersion is heated at a temperature close to the glass transition temperature of the resin particles (specifically, for example, from a temperature 30° C. lower than the glass transition temperature of the resin particles to a temperature 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) while stirring the mixed dispersion using a rotary shearing-type homogenizer, the pH of the mixed dispersion may be adjusted to acidic (for example, the pH is from 2 to 5), a dispersion stabilizer may be added if necessary, and the heating may be then performed.

Examples of the aggregating agent include a surfactant having an opposite polarity to the polarity of the surfactant to be added to the mixed dispersion, such as inorganic metal salts and di- or higher valent metal complexes. Particularly, when a metal complex is used as the aggregating agent, the amount of the surfactant used is reduced and charging characteristics are improved.

If necessary, an additive may be used to form a complex or a similar bond with the metal ions of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, or aluminum sulfate; and inorganic metal salt polymers such as polyaluminum chloride, polyhydroxy aluminum, or calcium polysulfide.

A water-soluble chelating agent may be used as the chelating agent. Examples of the chelating agent include oxycarboxylic acids such as tartaric acid, citric acid, and gluconic acid; and aminocarboxylic acids such as iminodiacetic acid (IDA), nitrilotriacetic acid (NTA), and ethylenediaminetetraacetic acid (EDTA).

The amount of the chelating agent added is, for example, preferably from 0.01 parts by weight to 5.0 parts by weight, and more preferably from 0.1 part by weight to less than 3.0 parts by weight with respect to 100 parts by weight of the resin particles.

—Coalescence Process—

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating a second aggregated particle dispersion in which the second aggregated particles are dispersed, thereby forming toner particles having a core-shell structure.

Here, after the coalescence process ends, the toner particles formed in the solution are subjected to known washing process, solid-liquid separation process, and drying process, and thus dry toner particles are obtained.

In the washing process, displacement washing using ion exchange water may be sufficiently performed from the viewpoint of charging properties. In addition, the solid-liquid separation process is not particularly limited, but from the viewpoint of productivity, suction filtration, pressure filtration, and the like may be performed. The method for the drying process is also not particularly limited, but from the viewpoint of productivity, freeze drying, flash jet drying, fluidized drying, vibration type fluidized drying, and the like may be performed.

The toner is prepared by, for example, adding and mixing an external additive with the obtained dry toner particles. The mixing may be performed with, for example, a V-blender, a HENSHEL mixer, a Lodige mixer, and the like. Furthermore, if necessary, coarse toner particles may be removed using a vibration sieving machine, a wind classifier, and the like.

<Electrostatic Charge Image Developer>

An electrostatic charge image developer according to this exemplary embodiment includes at least the toner according to this exemplary embodiment. The electrostatic charge image developer according to the exemplary embodiment may be a single component developer including only the toner according to the exemplary embodiment and may be a two-component developer obtained by mixing the toner and a carrier.

The carrier is not particularly limited and a known carrier may be used. Examples of the carrier include resin coated carriers having a resin coating layer on the surface of the core formed of a magnetic powder, magnetic powder dispersion type carriers in which a magnetic powder is dispersed and blended in a matrix resin, and resin impregnation type carriers in which a porous magnetic powder is impregnated with resin. The magnetic dispersed carriers and resin impregnated carriers may be carriers in which the constituent particles of the carrier are cores and coated with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic ester copolymer, a straight silicone resin configured to include an organosiloxane bond or a modified product thereof, a fluororesin, polyester, polycarbonate, a phenol resin, and an epoxy resin. The coating resin and the matrix resin may contain other additives such as conductive particles. Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin and various additives (used if necessary) are dissolved in an appropriate solvent may be used to coat the surface of the core with the coating resin. The solvent is not particularly limited, and may be selected in consideration of the resin to be used, coating suitability, and the like. Specific examples of the resin coating method include a dipping method of dipping cores in a coating layer forming solution; a spraying method of spraying a coating layer forming solution onto surfaces of cores; a fluidized bed method of spraying a coating layer forming solution onto cores in a state in which the cores are allowed to float by flowing air; and a kneader-coater method in which cores of a carrier and a coating layer forming solution are mixed with each other in a kneader-coater and the solvent is removed.

The mixing ratio (weight ratio) between the toner and the carrier in the two-component developer is preferably from 1:100 to 30:100 (toner:carrier), and more preferably from 3:100 to 20:100.

<Image Forming Apparatus, Image Forming Method>

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including the processes of: charging a surface of an image holding member, forming an electrostatic charge image on the charged surface of the image holding member, developing the electrostatic charge image formed on the surface of the image holding member with the electrostatic charge image developer according to this exemplary embodiment to form a toner image, transferring the toner image formed on the surface of the image holding member onto a surface of a recording medium, and fixing the toner image transferred onto the surface of the recording medium is performed.

As the image forming apparatus according to this exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member before charging after transfer of a toner image; or an apparatus that is provided with an erasing unit that irradiates, after transfer of a toner image, a surface of an image holding member with erase light before charging for erasing.

In the case in which the image forming apparatus according to this exemplary embodiment is an intermediate transfer type apparatus, a transfer unit is configured to have, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a portion including the developing unit may have a cartridge structure (process cartridge) that is detachable from the image forming apparatus. As the process cartridge, for example, a process cartridge provided with a developing unit that accommodates the electrostatic charge image developer according to the exemplary embodiment is suitably used.

Hereinafter, an example of the image forming apparatus according to the exemplary embodiment will be shown. However, the image forming apparatus is not limited thereto. Main parts shown in the drawing will be described, but descriptions of other parts will be omitted.

FIG. 1 is a schematic diagram showing the configuration of the image forming apparatus according to this exemplary embodiment.

The image forming apparatus shown in FIG. 1 includes first to fourth electrophotographic image forming units 10Y, 10M, 10C, and 10K (image forming units) that output yellow (Y), magenta (M), cyan (C), and black (K) images based on color separated image data, respectively. These image forming units (hereinafter, simply referred to as "units" in some cases) 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 (an example of the intermediate transfer member) is installed above the units 10Y, 10M, 10C, and 10K in the drawing to extend through the respective units. The intermediate transfer belt 20 is wound around a driving roll 22 and a support roll 24 contacting the inner surface of the intermediate transfer belt 20 and travels in a direction toward the fourth unit 10K from the first unit 10Y. The support roll 24 is pressed in a direction in which the support roll departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Each color toner, that is, a yellow toner, a magenta toner, a cyan toner, and a black toner accommodated in toner cartridges 8Y, 8M, 8C, and 8K are supplied to developing devices (an example of the developing units) 4Y, 4M, 4C, and 4K of the respective units 10Y, 10M, 10C, and 10K, respectively.

The first to fourth units 10Y, 10M, 10C, and 10K have the same configuration and operations. Thus, the first unit 10Y that is disposed on the upstream side in a traveling direction of the intermediate transfer belt to form a yellow image will be representatively described.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is arranged inside the intermediate transfer belt 20 so as to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of from −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (the resistance of a general resin), but has properties in which when laser beams are applied, the specific resistance of a portion that is irradiated with the laser beams changes. Accordingly, the laser beams 3Y are applied to the charged surface of the photoreceptor 1Y from the exposure device 3 in accordance with image data for yellow sent from the controller (not shown). Thus, an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by applying the laser beams 3Y to the photosensitive layer so that the specific resistance of the irradiated portion is lowered to cause charges to flow on the surface of the photoreceptor 1Y, while charges stay on a portion to which the laser beams 3Y are not applied.

The electrostatic charge image that is formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the electrostatic charge that is charged on the photoreceptor 1Y, and is thus held on the developer roll (an example of the developer holding member). By allowing the surface of the photoreceptor 1Y to pass through the developing device 4Y, the yellow toner electrostatic ally adheres to an erased latent image portion on the surface of the photoreceptor 1Y, and the latent image is developed with the yellow toner. Next, the photoreceptor 1Y having the yellow toner image formed thereon travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, an electrostatic force toward the primary transfer roll 5Y from the photoreceptor 1Y acts on the toner image, and the toner image on the photoreceptor 1Y is transferred onto the intermediate transfer belt 20. The transfer bias applied at this time has the polarity (+) opposite to the toner polarity (−), and is controlled to, for example, +10 μA in the first unit 10Y by the controller (not shown).

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer portion that includes the intermediate transfer belt 20, the support roll 24 contacting the inner surface of the intermediate transfer belt, and a secondary transfer roll (an example of the secondary transfer unit) 26 arranged on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, and the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure contacting portion (nip portion) between a pair of fixing rolls in a fixing device (an example of the fixing unit) 28 so that the toner image is fixed to the recording sheet P to form a fixed image.

Examples of the recording sheet P onto which a toner image is transferred include plain paper that is used in electrophotographic copiers, printers, and the like. As a recording medium, an OHP sheet and the like are also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are suitably used.

The recording sheet P on which the fixing of the color image is completed is discharged toward a discharge portion, and a series of the color image forming operations ends.

<Process Cartridge and Toner Cartridge>

A process cartridge according to this exemplary embodiment will be described.

The process cartridge according to this exemplary embodiment includes a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing unit, and if necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Main parts shown in the drawing will be described, but descriptions of other parts will be omitted.

Figure 2:
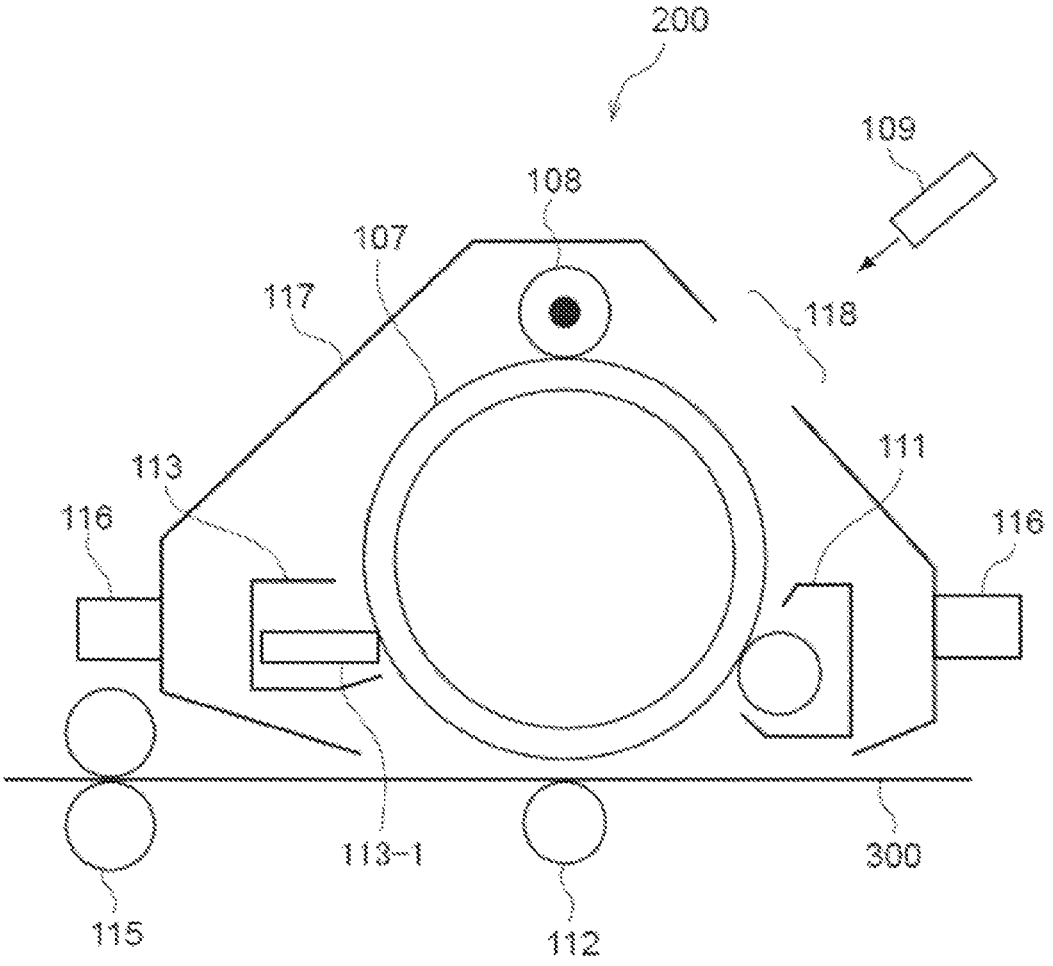
FIG. 2 is a schematic diagram showing an example of a configuration of a process cartridge according to an exemplary embodiment.

FIG. 2 is a schematic diagram showing the configuration of the process cartridge according to this exemplary embodiment A process cartridge 200 shown in FIG. 2 is formed as a cartridge having a configuration in which a photoreceptor 107 (an example of the image holding member), a charging roll 108 (an example of the charging unit) provided around the photoreceptor 107, a developing device 111 (an example of the developing unit), and a photoreceptor cleaning device 113 (an example of the cleaning unit) are integrally combined and held by, for example, a casing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment is a toner cartridge that accommodates the toner according to the exemplary embodiment and is detachable from an image forming apparatus. The toner cartridge accommodates a toner for replenishment for being supplied to the developing unit provided in the image forming apparatus.

The image forming apparatus shown in FIG. 1 has a configuration in which the toner cartridges 8Y, 8M, 8C, and 8K are detachable therefrom, and the developing devices 4Y, 4M, 4C, and 4K are connected to the toner cartridges corresponding to the respective colors with toner supply tubes (not shown), respectively. In addition, when the toner accommodated in the toner cartridge runs low, the toner cartridge is replaced.

EXAMPLES

Hereinafter, the exemplary embodiments of the invention will be described more specifically using Examples and Comparative Examples, but are not limited to these examples. Unless specifically noted, the terms "parts" and "%" means "parts by weight" and "% by weight".

<Synthesis of Hybrid Amorphous Resin and Preparation of Amorphous Resin Particle Dispersion>

[Hybrid Amorphous Resin H1 and Amorphous Resin Particle Dispersion H1]

—Synthesis of Amorphous Polyester Resin P1—

A four-necked flask equipped with a nitrogen introduction tube, a dewatering conduit, a stirrer, and a thermocouple is purged with nitrogen, 150 parts by mole of ethylene glycol, 84 parts by mole of terephthalic acid, and 9 parts by mole of dodecenylsuccinic anhydride are put into the flask, and the temperature is raised to 235° C. while stirring in a nitrogen atmosphere, and the temperature is maintained for 5 hours.

Next, the pressure in the flask is reduced to 8.0 kPa and maintains for 1 hour. After the pressure in the flask is returned to the pressure of the atmosphere, the mixture is cooled to 190° C., and 5 parts by mole of fumaric acid and 2 parts by mole of trimellitic acid are added thereto. The temperature is maintained at 190° C. for 2 hours and then rises to 210° C. for 2 hours. Next, the pressure in the flask is reduced to 8.0 kPa and maintained for 4 hours, and then alcohol is distilled. Thus, amorphous polyester resin P1 is obtained.

—Styrene Acryl Modification of Amorphous Polyester Resin P1 and Preparation of Amorphous Resin Particle Dispersion H1—

80 parts by weight of Amorphous polyester resin P1 is put in a 2 L four-necked flask equipped with a cooling tube, a stirrer, and a thermocouple, followed by stirring at a stirring rate of 200 rpm in a nitrogen atmosphere. Then, a total 20 parts by weight of styrene and ethyl acrylate, as addition polymerizable monomers, are added at a ratio of 60 parts by mole:40 parts by mole, 500 parts by weight of ethyl acetate as a solvent is added and the components are mixed for 30 minutes.

Further, with respect to a total 1,000 parts of Amorphous polyester resin P1 and addition polymerizable monomers, 6 parts of polyoxyethylene alkyl ether (nonionic surface active agent, EMULGEN 430 manufactured by Kao Corporation), 40 parts of a 15% aqueous sodium dodecylbenzenesulfonate solution (anionic surfactant, NEOPELEX G-15 manufactured by Kao Corporation), and 233 parts of a 5% aqueous potassium hydroxide solution are put in the flask and the temperature is raised to 95° C. while stirring to melt the contents. The contents are mixed at 95° C. for 2 hours and thus a resin mixture solution was obtained.

Next, while stirring, 1,145 parts of deionized water is added dropwise thereto at a rate of 6 parts/min and thus an emulsion is obtained. Next, the emulsion is cooled to 25° C. and sieved through a 200 mesh wire net. The solid content concentration is adjusted to 20% by adding deionized water and thus Amorphous resin particle dispersion H1 in which Hybrid amorphous resin H1 is dispersed was obtained.

[Hybrid Amorphous Resins H2 to H5 and Amorphous Resin Particle Dispersions H2 to H5]

Hybrid amorphous resins H2 to H5 and Amorphous resin particle dispersions H2 to H5 are obtained in the same manner as in the synthesis of Hybrid amorphous resin H1 and the preparation of Amorphous resin particle dispersion H1 except that the alcohol component, the carboxylic acid component, and the addition polymerizable monomer are changed as shown in Table 1.

Abbreviations used in Table 1 have the following meanings. EG: ethylene glycol, PG: propylene glycol, BD: 1,4-butanediol, NPG: neopentyl glycol, BPA-PO: bisphenol A-propylene oxide 2 mol adduct, TPA: terephthalic acid, DSA: dodecenylsuccinic anhydride, SA: sebacic acid, FA: fumaric acid, TMA: trimellitic acid, St: styrene, EA: ethyl acrylate.

<Synthesis of Crystalline Polyester Resin and Preparation of Crystalline Resin Particle Dispersion>

[Crystalline Polyester Resin CP1 and Crystalline Resin Particle Dispersion CP1]

—Synthesis of Crystalline Polyester Resin CP1—

1,6-Hexanediol: 100 parts by mole

Dodecanedioic acid (1,10-decane dicarboxylic acid): 100 parts by mole

The above materials are put into a reaction vessel equipped with a stirrer, a thermometer, a condenser, and a nitrogen introduction tube, the reaction vessel is purged with dry nitrogen gas, and then 0.3 parts of tin dioctanate with respect to a total 100 parts of the above materials is added. The reaction is carried out under a nitrogen gas stream at 160° C. for 3 hours with stirring and then the temperature is raised to 180° C. for 1.5 hours. The pressure in the reaction vessel is reduced to 3 kPa and the reaction is terminated when a target molecular weight is obtained. Thus, Crystalline polyester resin CP1 is obtained.

—Preparation of Crystalline Resin Particle Dispersion CP1—

Crystalline polyester resin CP1: 100 parts

Ethyl acetate: 60 parts

Isopropyl alcohol: 15 parts

The above materials are put into a reaction vessel equipped with a stirrer and are melted at 65° C. After confirming that the materials are melted, the reaction vessel is cooled to 60° C. and 5 parts of a 10% aqueous ammonia solution is added thereto. Next, 300 parts of ion exchange water is added dropwise into the reaction vessel for 3 hours and thus a resin dispersion is prepared. Next, ethyl acetate and isopropyl alcohol are removed by an evaporator and then ion exchange water is added to adjust the solid content concentration to 20%. Thus, Crystalline resin particle dispersion CP1 is obtained.

[Crystalline Polyester Resins CP2 to CP5 and Crystalline Resin Particle Dispersions CP2 to CP5]

Crystalline polyester resins CP2 to CP5 and crystalline resin particle dispersions CP2 to CP5 are obtained in the same manner as in the preparation of Crystalline polyester resin CP1 and the preparation of Crystalline resin particle

TABLE 1

| Hybrid amorphous resin | Polyester resin segment (main chain) | | | | | | | | | | Styrene acrylic resin segment (side chain) Addition polymerizable monomer (ratio in total monomers, % by mole) | | Mw of resin | Tg of resin |
|---|---|---|---|---|---|---|---|---|---|---|---|---|---|---|
| | Alcohol component (ratio in corresponding component, % by mole) | | | | | Carboxylic acid component (ratio in corresponding component, % by mole) | | | | | | | | |
| | EG | PG | BD | NPG | BPA-PO | TPA | DSA | SA | FA | TMA | St | EA | | |
| Resin H1 | 100 | — | — | — | — | 84 | 9 | — | 5 | 2 | 60 | 40 | 25,000 | 62 |
| Resin H2 | — | 100 | — | — | — | 83 | 9 | — | 5 | 3 | 60 | 40 | 24,500 | 60 |
| Resin H3 | — | 70 | — | — | 30 | 74 | 14 | 5 | 5 | 2 | 50 | 50 | 26,000 | 59 |
| Resin H4 | — | 65 | 15 | 20 | — | 64 | 9 | 18 | 5 | 4 | 60 | 40 | 27,000 | 56 |
| Resin H5 | — | 65 | — | — | 35 | 69 | 9 | 14 | 5 | 3 | 60 | 40 | 25,500 | 58 |

dispersion CP1 except that the alcohol component and the carboxylic acid component are changed as shown in Table 2.

[Crystalline Styrene-Acryl-Modified Polyester Resins CP6 to CP7, and Crystalline Resin Particle Dispersions CP6 to CP7]

Crystalline styrene-acryl-modified polyester resins CP6 and CP7, and crystalline resin particle dispersions CP6 and CP7 are obtained in the same manner as in the synthesis of Hybrid amorphous resin H1 and the preparation of Amorphous resin particle dispersion H1 except that the alcohol component, the carboxylic acid component, and the addition polymerizable monomers are changed as shown in Table 2 and the amount of the addition polymerizable monomers added is changed to a total 10 parts by weight with respect to 90 parts by weight of the polyester resin.

TABLE 2

| Crystalline | Main chain | | | | | | | | Side chain Addition | | | |
|---|---|---|---|---|---|---|---|---|---|---|---|---|
| | Alcohol component (ratio in corresponding component, % by mole) | | | | Carboxylic acid component (ratio in corresponding component, % by mole) | | | | polymerizable monomer (ratio in total monomers, % by mole) | | | |
| polyester resin | EG | HD | DD | DDD | APA | DDA | TDA | FA | St | EA | Mw of resin | Tm of resin |
| Resin CP1 | — | 100 | — | — | — | 100 | — | — | — | — | 27,000 | 74 |
| Resin CP2 | — | — | 100 | — | 100 | — | — | — | — | — | 28,500 | 76 |
| Resin CP3 | 100 | — | — | — | — | 100 | — | — | — | — | 26,500 | 80 |
| Resin CP4 | — | — | — | 100 | — | 100 | — | — | — | — | 22,500 | 80 |
| Resin CP5 | — | 100 | — | — | — | — | 100 | — | — | — | 32,500 | 70 |
| Resin CP6 | — | 100 | — | — | — | 95 | — | 5 | 60 | 40 | 29,500 | 70 |
| Resin CP7 | — | 100 | — | — | 95 | — | — | 5 | 60 | 40 | 23,500 | 73 |

Abbreviations used in Table 2 have the following meanings. EG: ethylene glycol, HD: 1,6-hexanediol, DD: 1,10-decanediol, DDD: 1,12-dodecanediol, APA: adipic acid, DDA: dodecanedioic acid, TDA: tridecanedioic acid, FA: fumaric acid, St: styrene, EA: ethyl acrylate.

<Preparation of Release Agent Dispersion>

Hydrocarbon wax (FNP0090, manufactured by Nippon Seiro Co., Ltd.): 270 parts

Anionic surfactant (Taycapower BN2060, manufactured by TAYCA CORPORATION, amount of effective component: 60%): 13.5 parts Ion exchange water: 700 parts The above materials are mixed, and a release agent is dissolved at an internal liquid temperature of 120° C. using a pressure discharge type homogenizer (Golline homogenizer manufactured by Manton-Gaulin Corporation). Then, a dispersion treatment is carried out at a dispersion pressure of 5 MPa for 120 minutes and subsequently at 40 MPa for 360 minutes. Thereafter, cooling is performed and the solid content concentration is adjusted to 20% by adding ion exchange water. Thus, a release agent dispersion is obtained. The volume average particle diameter D50v of the release agent dispersion is 220 nm.

<Preparation of Colorant Dispersion>

C.I. pigment blue 15:3 (manufactured by Dainichiseika Color & Chemicals Mfg. Co., Ltd.): 50 parts Anionic surfactant (Neogen RK, manufactured by DKS Co. Ltd, amount of effective component: 20%)
: 2 parts Ion exchange water: 180 parts The above materials are mixed and the mixture was dispersed for 1 hour using a high pressure impact type dispersing machine ULTIMIZER (HJP30006, manufactured by Sugino Machine, Ltd.). The solid content concentration is adjusted to 20% by adding ion exchange water and thus a colorant dispersion is obtained. The volume average particle diameter D50v of the colorant dispersion is 150 nm.

<Preparation of Resin Coating Carrier>

Mn—Mg—Sr ferrite particles (average particle diameter: 40 μm): 100 parts

Toluene: 14 parts

Polymethylmethacrylate: 2 parts

Carbon black (VXC72 manufactured by Cabot Corporation): 0.12 parts

The above materials excluding ferrite particles and glass beads (ϕ1 mm, the same amount as the amount of toluene) are stirred using a sand mill manufactured by Kansai Paint Co., Ltd. at 1,200 rpm for 30 minutes and thus a resin coating layer forming solution is obtained. The resin coating layer forming solution and the ferrite particles are put into a vacuum degassing type kneader, toluene is distilled under reduced pressure, and the resultant is dried. Thus, a resin coated carrier is obtained.

Example 1

Preparation of Toner Particles

Amorphous resin particle dispersion H2 (solid content concentration: 20%): 485 parts Crystalline resin particle dispersion CP1 (solid content concentration: 20%): 214 parts Release agent dispersion (solid content concentration: 20%): 120 parts Colorant dispersion (solid content concentration: 20%): 147 parts Anionic surfactant (Neogen RK, manufactured by DKS Co. Ltd, amount of effective component: 20%): 4 parts Ion exchange water: 333 parts The above materials are put into a reaction vessel equipped with a thermometer, a pH meter, and a stirrer, and the reaction vessel is heated to a temperature of 30° C. from the outside using a mantle heater. The contents of the reaction vessel are kept for 30 minutes while stirring the contents at a stirring rate of 150 rpm. Thereafter, a 0.3 N aqueous nitric acid solution is added thereto and the pH is adjusted to 3.0. Next, a 3% aqueous polyaluminum chloride solution is added while dispersing using a homogenizer (ULTRA TURRAX T50 manufactured by IKA). Next, the temperature is raised to 50° C. while stirring and is kept for 30 minutes. Then, 372 parts of Amorphous resin particle dispersion H2 is added, the resultant mixture is kept for 1 hour, and a 0.1 N aqueous sodium hydroxide solution is added to adjust the pH to 8.5. Then, the resultant is heated to 85° C., while continuing stirring, and kept for 5 hours. Thereafter, the reaction product is cooled, filtered, washed with ion exchange water, and dried. Thus, toner particles having a volume average particle diameter of 6.0 μm are obtained.

[Preparation of External Toner]

100 parts of the obtained toner particles and 1.5 parts of hydrophobic silica (RY50, manufactured by Nippon Aerosil Co. Ltd.) are mixed using a sample mill at 13,000 rpm for 30 seconds and the mixture is sieved using a vibration sieve having an opening of 45 μm. Thus, an external toner is obtained.

[Preparation of Developer]

36 parts of the obtained external toner and 414 parts of a resin coated carrier are put into a 2 liter V blender and the mixture is stirred for 20 minutes and sieved using a sieve having an opening of 212 μm. Thus, a developer is obtained.

Examples 2 to 9 and Comparative Examples 1 to 3

Toner particles, external additives, and developers of Examples 2 to 9 and Comparative Examples 1 to 3 are prepared in the same manner as in Example 1 except that Amorphous resin particle dispersion H2 and Crystalline resin particle dispersion CP1 are changed to amorphous resin particle dispersions and crystalline resin particle dispersions shown in Table 3 and the mixing ratio between the amorphous resin and the crystalline resin is changed as shown in Table 3.

<Evaluation>

[Measurement of Loss Modulus G"]

The loss modulus G" of each toner is measured by the aforementioned measurement. The results are shown in Table 3.

[Low Temperature Fixability]

A developer unit of a modified machine of DOCUCENTRE COLOR 400 CP manufactured by Fuji Xerox Co., Ltd, (including an external fixing machine whose fixing temperature is variable) is filled with each developer and a 50 mm×50 mm image with image density of 100% is formed on C2 paper manufactured by Fuji Xerox Co., Ltd in a toner applied amount of 10 g/m$^2$. The fixing of the toner image to the paper is performed at a fixing pressure of 10 kgf/cm$^2$ and a fixing rate of 180 mm/sec. The fixing temperature is raised from 110° C. to 160° C. with an interval of 5° C. The temperature at which offset (a phenomenon that an image is transferred to a fixing member, which is caused by insufficient melting of a toner image) does not occur on the low temperature side (lowest fixing temperature) is classified as shown below. The results are shown in Table 3.

5: The lowest fixing temperature was 120° C. or lower.

4: The lowest fixing temperature was higher than 120° C. and 125° C. or lower.

3: The lowest fixing temperature was higher than 125° C. and 130° C. or lower.

2: The lowest fixing temperature was higher than 130° C. and 140° C. or lower.

[Heat Resistance]

The image forming apparatus is filled with 800 g of the developer and the fixing temperature is set to 150° C. In an environment at a temperature of 25° C. and a relative humidity of 55%, a test chart image with an image density of 5% is formed on 10,000 sheets of A4 size C2 paper manufactured by Fuji Xerox Co., Ltd. After the image is formed on 10,000 sheets, the developer in the developer unit is taken out, sieved through a sieve having an opening of 45 μm, and vibrated at a vibration width of 1.5 mm for 20 seconds to divide the developer into a toner and a carrier. Next, the toner is sieved through a sieve having an opening of 38 μm and vibrated at a vibration width of 1.5 mm for 20 seconds. The amount of residual toner remaining on the sieve is weighed, and the residual rate (the amount of residual toner/the amount of toner on the sieve) is classified as shown below. The results are shown in Table 3.

5: There was no toner remaining.

4: The residual rate was more than 0% by weight and 25% by weight or less.

3: The residual rate was more than 25% by weight and 40% by weight or less.

2: The residual rate was more than 40% by weight and 80% by weight or less.

TABLE 3

| | Binder resin | | | | | | Evaluation | |
|---|---|---|---|---|---|---|---|---|
| | Amorphous resin particle dispersion | Crystalline resin particle dispersion | Mixing ratio of resins | Loss Modulus G" [Pa] 40° C. | 55° C./0 min | 55° C./60 min | Low temperature fixability | Heat resistance |
| Example 1 | H2 | CP1 | 80:20 | $3.0 \times 10^7$ | $4.0 \times 10^7$ | $2.8 \times 10^8$ | 4 | 5 |
| Example 2 | H3 | CP1 | 80:20 | $2.1 \times 10^7$ | $3.2 \times 10^7$ | $2.6 \times 10^8$ | 4 | 5 |
| Example 3 | H2 | CP2 | 80:20 | $3.5 \times 10^7$ | $4.5 \times 10^7$ | $1.5 \times 10^8$ | 4 | 4 |
| Example 4 | H1 | CP1 | 80:20 | $2.5 \times 10^7$ | $3.0 \times 10^7$ | $1.0 \times 10^8$ | 4 | 4 |
| Example 5 | H4 | CP1 | 80:20 | $1.3 \times 10^7$ | $2.5 \times 10^7$ | $1.2 \times 10^8$ | 4 | 4 |
| Example 6 | H2 | CP1 | 70:30 | $1.1 \times 10^7$ | $2.3 \times 10^7$ | $8.0 \times 10^8$ | 5 | 5 |
| Example 7 | H2 | CP3 | 80:20 | $2.0 \times 10^7$ | $2.6 \times 10^7$ | $2.2 \times 10^8$ | 4 | 4 |
| Example 8 | H2 | CP6 | 80:20 | $3.5 \times 10^7$ | $4.0 \times 10^7$ | $2.6 \times 10^8$ | 4 | 5 |
| Example 9 | H2 | CP7 | 80:20 | $1.0 \times 10^7$ | $2.0 \times 10^7$ | $1.9 \times 10^8$ | 5 | 4 |
| Comparative Example 1 | H1 | CP4 | 80:20 | $1.2 \times 10^8$ | $1.6 \times 10^8$ | $3.2 \times 10^8$ | 2 | 5 |
| Comparative Example 2 | H1 | CP5 | 80:20 | $4.5 \times 10^7$ | $3.0 \times 10^7$ | $7.5 \times 10^7$ | 4 | 2 |
| Comparative Example 3 | H5 | CP1 | 80:20 | $1.4 \times 10^8$ | $2.0 \times 10^8$ | $3.2 \times 10^8$ | 2 | 5 |

DESCRIPTION OF REFERENCE NUMERALS AND SIGNS

1Y, 1M, 1C, 1K: Photoreceptor (example of image holding member), 2Y, 2M, 2C, 2K: Charging roll (example of charging unit), 3: Exposure device (example of electrostatic charge image forming unit), 3Y, 3M, 3C, 3K: Laser beam, 4Y, 4M, 4C, 4K: Developing device (example of developing unit), 5Y, 5M, 5C, 5K: Primary transfer roll (example of primary transfer unit), 6Y, 6M, 6C, 6K: Photoreceptor cleaning device, 8Y, 8M, 8C, 8K: Toner cartridge, 10Y, 10M, 10C, 10K: Image forming unit, 20: Intermediate transfer belt (example of intermediate transfer member), 22: Driving roll, 24: Support roll, 26: Secondary transfer roll (example of secondary transfer unit), 28: Fixing device (example of fixing unit), 30: Intermediate transfer member cleaning device, P: recording medium (example of recording medium)

107: Photoreceptor (example of image holding member), 108: Charging roll (example of charging unit), 109: Exposure device (example of electrostatic charge image forming unit), 111: Developing device (example of developing unit), 112 transfer device (example of transfer unit), 113: Photoreceptor cleaning device (example of cleaning unit), 115 Fixing device (example of fixing unit), 116: Mounting rail, 117: Casing, 118: Opening for exposure, 200: Process cartridge, 300: Recording paper (example of recording medium)

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and there equivalents.

What is claimed is:

1. An electrostatic charge image developing toner comprising:

a toner particle containing an amorphous resin having a polyester resin segment and a styrene acrylic resin segment, and a crystalline polyester resin dispersed in the amorphous resin, wherein the amorphous resin has one selected from the group consisting of: (i) a main chain composed of the polyester resin segment and a side chain composed of the styrene acrylic resin segment chemically bonded to the main chain; (ii) a main chain composed of the styrene acrylic resin segment and a side chain composed of the polyester resin segment chemically bonded to the main chain; and (iii) a main chain formed by chemically bonding the polyester resin segment and the styrene acrylic resin segment, wherein the styrene acrylic resin segment in the amorphous resin is formed by addition of styrene and an acrylate as addition polymerizable monomers, where the ratio of the styrene to acrylate addition polymerizable monomers is in the range of 50:50 to 60:40 by mole, wherein a loss modulus G" of the toner particles satisfies the following (1) and (2):

(1) the loss modulus G" at 40° C. is from $1.0\times10^7$ Pa to $1.0\times10^8$ Pa; and (2) the loss modulus G" at the time when 60 minutes has passed from start of keeping the toner particles at 55° C. is from $1.0\times10^8$ Pa to $1.0\times10^9$ Pa.

2. The electrostatic charge image developing toner according to claim 1, wherein the loss modulus G" of the toner particles satisfies the following (3):

(3) the loss modulus G" at start of keeping the toner particles at 55° C. is from $5.0\times10^6$ Pa to $5.0\times10^7$ Pa.

3. The electrostatic charge image developing toner according to claim 1, wherein a weight ratio between the amorphous resin and the crystalline polyester resin is from 80:20 to 70:30.

4. The electrostatic charge image developing toner according to claim 1, wherein the crystalline polyester resin is a styrene-acryl-modified polyester resin.

5. The electrostatic charge image developing toner according to claim 1, wherein the polyester resin segment of the amorphous resin is a condensation polymer of an alcohol component and a carboxylic acid component, and an amount of an aliphatic diol having 2 to 5 carbon atoms is from 70% by mole to 100% by mole of the alcohol component.

6. The electrostatic charge image developing toner according to claim 1, wherein a main chain of the crystalline polyester resin is a condensation polymer of an alcohol component and a carboxylic acid component, and the alcohol component includes an aliphatic diol having 2 to 10 carbon atoms and the carboxylic acid component includes a dicarboxylic acid having 6 to 12 carbon atoms.

7. The electrostatic charge image developing toner according to claim 2, wherein a weight ratio between the amorphous resin and the crystalline polyester resin is from 80:20 to 70:30.

8. The electrostatic charge image developing toner according to claim 2, wherein the crystalline polyester resin is a styrene-acryl-modified polyester resin.

9. The electrostatic charge image developing toner according to claim 2, wherein the polyester resin segment of the amorphous resin is a condensation polymer of an alcohol component and a carboxylic acid component, and an amount of an aliphatic diol having 2 to 5 carbon atoms is from 70% by mole to 100% by mole of the alcohol component.

10. The electrostatic charge image developing toner according to claim 2, wherein a main chain of the crystalline polyester resin is a condensation polymer of an alcohol component and a carboxylic acid component, and the alcohol component includes an aliphatic diol having 2 to 10 carbon atoms and the carboxylic acid component includes a dicarboxylic acid having 6 to 12 carbon atoms.

11. An electrostatic charge image developer comprising:

the electrostatic charge image developing toner according to claim 1; and a carrier.

12. A toner cartridge that is detachable from an image forming apparatus and comprising a container that accommodates the electrostatic charge image developing toner according to claim 1 in an accommodation portion of the toner cartridge.

* * * * *